US008297334B2

(12) United States Patent
Chu

(10) Patent No.: US 8,297,334 B2
(45) Date of Patent: Oct. 30, 2012

(54) SLIDING PANEL

(76) Inventor: Chen-Ho Chu, Taipei (TW)

( * ) Notice: Subject to any disclaimer, the term of this patent is extended or adjusted under 35 U.S.C. 154(b) by 437 days.

(21) Appl. No.: 11/526,087

(22) Filed: Sep. 25, 2006

(65) Prior Publication Data

US 2007/0261799 A1 Nov. 15, 2007

(30) Foreign Application Priority Data

May 12, 2006 (TW) ..... 95116895 A

(51) Int. Cl.
*E06B 3/12* (2006.01)
*E05D 15/06* (2006.01)

(52) U.S. Cl. ..... 160/222; 160/197; 160/202; 160/201; 160/196.1; 49/409; 49/425; 49/125

(58) Field of Classification Search ..... 160/222, 160/225, 226, 214, 197, 202, 196.1, 10, 178.1 R, 160/201; 211/105.3; 16/87.6 R, 91, 98; 49/409, 425, 125
See application file for complete search history.

(56) References Cited

U.S. PATENT DOCUMENTS 236,028 A * 12/1880 Herrmann ..... 160/39
259,716 A * 6/1882 Prescott ..... 49/411
1,421,431 A * 7/1922 Elliott ..... 49/426
2,658,571 A * 11/1953 Guth et al. ..... 160/193
2,858,408 A * 10/1958 Barroero ..... 49/70
2,929,115 A * 3/1960 Beckstrom ..... 49/411
3,110,506 A * 11/1963 O'Brien ..... 410/151
3,346,993 A * 10/1967 Johnson ..... 49/409
3,480,989 A * 12/1969 Edeus ..... 16/94 R
3,642,051 A * 2/1972 Goldner ..... 160/197
3,653,157 A * 4/1972 Casebolt ..... 49/411
3,896,508 A * 7/1975 Doan ..... 4/557
3,911,991 A * 10/1975 Malferrari ..... 160/202
3,975,862 A * 8/1976 Doan ..... 49/409
3,999,489 A * 12/1976 Kramer et al. ..... 105/378
4,073,034 A * 2/1978 Martens ..... 16/87 B
4,178,718 A * 12/1979 Laby ..... 49/411
(Continued)

OTHER PUBLICATIONS

Caster. (n.d.). Dictionary.com Unabridged. Retrieved Sep. 2, 2010, from Dictionary.com website: http://dictionary.reference.com/browse/caster (definition provided in the Office Action).*

*Primary Examiner* — Katherine W Mitchell
*Assistant Examiner* — Jaime F Cardenas-Garcia
(74) *Attorney, Agent, or Firm* — Muncy, Geissler, Olds & Lowe, PLLC

(57) ABSTRACT

A sliding panel includes multiple connecting/adjacent carrier tracks such as two/three/four carrier tracks while connectors of each carrier track are disposed in opposite directions or at intervals. Thus the multiple connecting/adjacent carrier tracks slide in parallel under the same channel. Moreover, the positions of each connector on top surface of respective carrier track are in alternating arrangement so as to allow runners of multiple connecting/adjacent carrier tracks being mounted inside the same channel simultaneously. The runners of the connecting/adjacent carrier tracks move inside the channel of a rail at the same time and the connecting/adjacent carrier tracks slide in parallel under the same channel. Therefore, the number of channels of the rail is decreased and the amount of material used for producing the rail is reduced. Furthermore, the rail can be designed to have two-step inner and outer rails for adjusting length of the rail. Moreover, each rail is disposed only with one channel and then a plurality of rails such as one/two/three rails are arranged in parallel to form a rail set for easy assembling.

9 Claims, 20 Drawing Sheets

U.S. PATENT DOCUMENTS 4,281,477 A * 8/1981 Kaminaga ..... 49/453
4,358,863 A * 11/1982 Jacobsen ..... 4/607
4,574,526 A * 3/1986 Lindquist ..... 49/411
4,635,699 A * 1/1987 Kauffman et al. ..... 160/211
4,769,949 A * 9/1988 Glendowne ..... 49/410
4,887,394 A * 12/1989 Marlowe ..... 49/409
4,998,304 A * 3/1991 Sauter et al. ..... 4/559
5,042,555 A * 8/1991 Owens ..... 160/199
5,079,872 A * 1/1992 Short ..... 49/409
5,109,910 A * 5/1992 Tortorella et al. ..... 160/197
5,123,128 A * 6/1992 Hines ..... 4/557
5,351,442 A * 10/1994 Gingras ..... 49/411
5,598,666 A * 2/1997 Kurth ..... 49/409
5,839,228 A * 11/1998 Duffy ..... 49/223
5,899,303 A * 5/1999 Allen ..... 187/333
5,927,367 A * 7/1999 Toti ..... 160/173 V
5,970,578 A * 10/1999 Mensching et al. ..... 16/94 R
6,082,499 A * 7/2000 O'Donnell ..... 187/324
6,209,171 B1 * 4/2001 Pelletier et al. ..... 16/97
6,360,487 B1 * 3/2002 Kern et al. ..... 49/231
6,381,904 B1 * 5/2002 Tedescucci ..... 49/409
6,467,127 B1 * 10/2002 Goldstein ..... 16/87 R
6,497,072 B2 * 12/2002 Fries ..... 49/209
6,571,855 B1 * 6/2003 Goldsmith et al. ..... 160/199
6,581,345 B2 * 6/2003 Goldsmith et al. ..... 52/243.1
6,612,638 B1 * 9/2003 Fliege et al. ..... 296/138
6,719,158 B2 * 4/2004 Goldberg ..... 211/123
6,880,607 B2 * 4/2005 Marocco ..... 160/173 R
6,892,783 B1 * 5/2005 Comeau et al. ..... 160/126
6,923,238 B2 * 8/2005 Kern et al. ..... 160/197
7,021,007 B2 * 4/2006 Jacobs ..... 49/425
7,107,699 B2 * 9/2006 Chang ..... 33/760
7,174,944 B1 * 2/2007 Clark et al. ..... 160/197
7,270,165 B1 * 9/2007 Chuang ..... 160/197
7,299,852 B1 * 11/2007 Chuang ..... 160/197
7,346,939 B2 * 3/2008 Perry ..... 4/557
7,424,935 B1 * 9/2008 Smith ..... 187/333
7,458,410 B1 * 12/2008 Bronner ..... 160/197
7,647,729 B2 * 1/2010 Polus ..... 49/425
7,762,305 B2 * 7/2010 Huang ..... 160/201
7,779,578 B2 * 8/2010 Gray ..... 49/506
2002/0062932 A1 * 5/2002 Kern et al. ..... 160/197
2002/0066228 A1 * 6/2002 Janutta et al. ..... 49/127
2003/0071001 A1 * 4/2003 Goldberg ..... 211/123
2004/0083653 A1 * 5/2004 Delgado et al. ..... 49/120
2006/0058698 A1 * 3/2006 Cha et al. ..... 600/538
2007/0017157 A1 * 1/2007 Ambrozus ..... 49/425
2007/0158036 A1 * 7/2007 Lin ..... 160/197
2008/0053938 A1 * 3/2008 Goldstein ..... 211/105.3
2008/0105388 A1 * 5/2008 Huang ..... 160/202
2008/0185111 A1 * 8/2008 Zagone ..... 160/379
2008/0230185 A1 * 9/2008 Kahn ..... 160/23.1

* cited by examiner

SLIDING PANEL

BACKGROUND OF THE INVENTION

The present invention relates to a sliding panel, especially to a sliding panel that uses a single channel on a rail for accommodation of a plurality of carrier tracks simultaneously sliding in parallel.

A sliding panel is one kind of screen and is composed of a rail, a plurality of carrier tracks mounted under the rail, and a plurality of panels attached to the carrier track. Two separating connectors are arranged on the top surface of each carrier track while a runner such as a caster is connected on top of the connector. By inserting the connector upwards through a channel opening on bottom of the rail, the runner slides inside the channel of the rail. Thus each of the carrier tracks and panels thereof slides transversely so as to make the panels extend or retract, overlapping with one another. There is a small overlapping area between the two adjacent panels after being extended so that the multiple panels form a continuous surface to achieve better shielding effect. Moreover, most of conventional sliding panels include one rail with a plurality of channels while each of the channels is disposed with a corresponding carrier track. The number of channels mounted on the rail depends on the width of the sliding panel. For example, there may be three, four, five or six channels on the rail of the sliding panel and each channel has a corresponding opening for insertion of the connector of the carrier track.

In marketing of fixed-size curtains, if the construction of the products allows users to adjust their size, the sales volume will increase. In traditional sliding panels, one rail is disposed with a plurality of channels. Once the rail is designed into an extendable rail consisting of an inner rail and an outer rail, it is difficult to form the extrusion of the rails precisely, so that the rails can't be telescoped smoothly. Furthermore, because of the bulky sizes of the rails, they need more material and cost more money. By using a one rail one channel construction, it is easier to form the extrusion of the inner and outer rails precisely, so that the rails can be telescoped smoothly. But another problem is encountered, since a sliding panel with 3 to 6 rails needs a lot of material and cost a lot of money. Furthermore, it is difficult to combine 3 to 6 rails and install them together.

SUMMARY OF THE INVENTION

Therefore it is a primary object of the present invention to provide a sliding panel that includes multiple adjacent carrier tracks such as two/three/four carrier tracks while connectors of each carrier track are disposed in opposite directions and/or at intervals. Thus the multiple adjacent carrier tracks slide in parallel under the same channel. Moreover, the positions of each connector on a top surface of respective carrier track are in alternating arrangement so as to allow the runners of multiple adjacent carrier tracks to be mounted inside the same channel simultaneously. The runners of several adjacent carrier tracks move inside the channel of a rail at the same time so that the adjacent carrier tracks slide in parallel under the same channel for extending or retracting the sliding panel.

Therefore, in a set of sliding panels, the number of channels of the rails is decreased and the amount of material used for producing the rail is reduced.

It is the other object of the present invention to provide a sliding panel that includes a channel on each rail and a rail set formed by at least one rail (such as one, two or three rails) arranged in parallel so as to meet the requirements of simplified rail set formation, precision, and easy assembling.

It is another object of the present invention to provide a sliding panel whose rail is composed of inner and outer rails so that the inner rail can be pulled out of the outer rail for adjusting the length of the rail.

DETAILED DESCRIPTION OF THE PREFERRED EMBODIMENT

Figure 1:
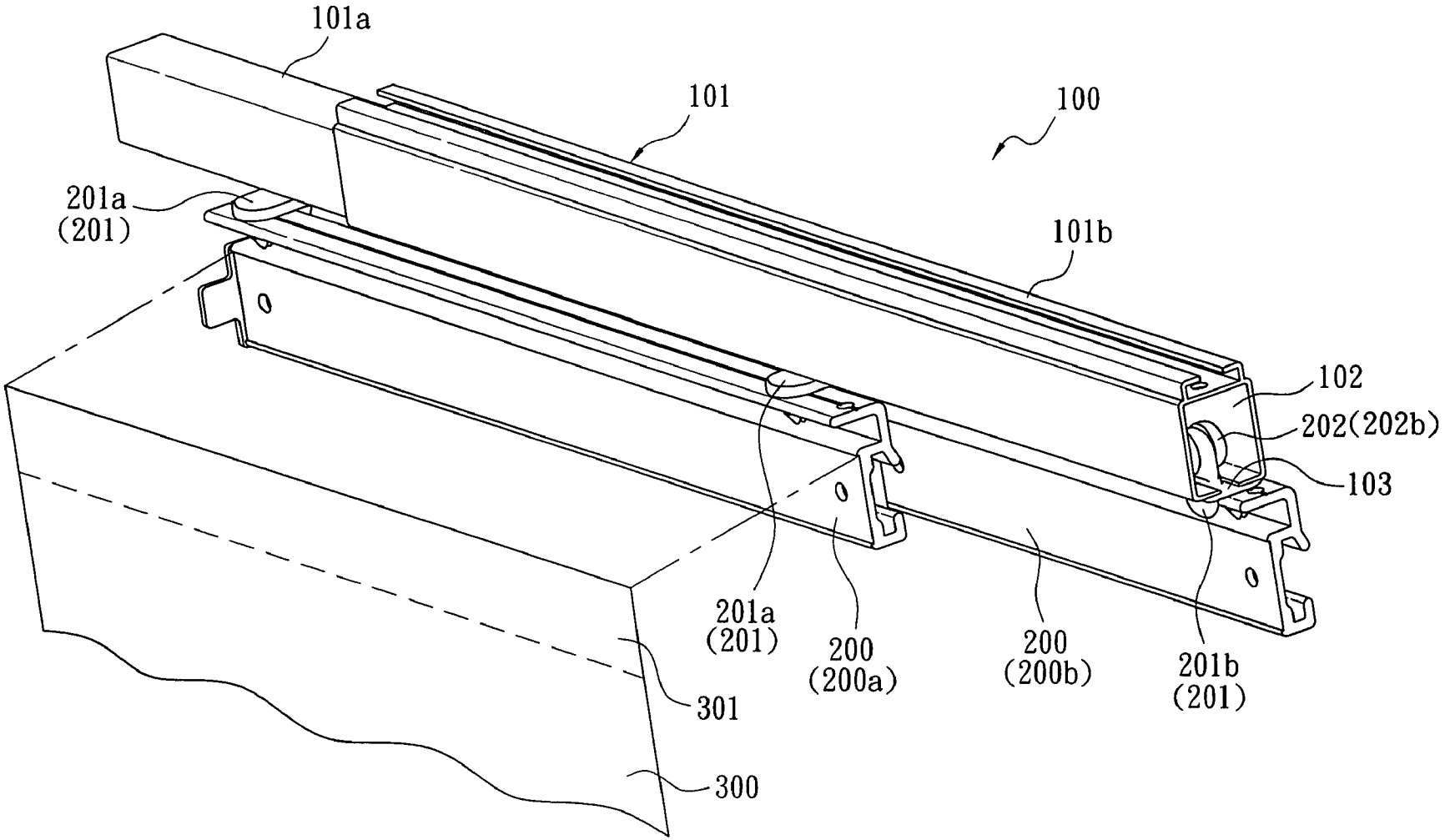
FIG. 1 is a perspective view of an embodiment having one rail and two carrier tracks in accordance with the present invention.
Figure 6:
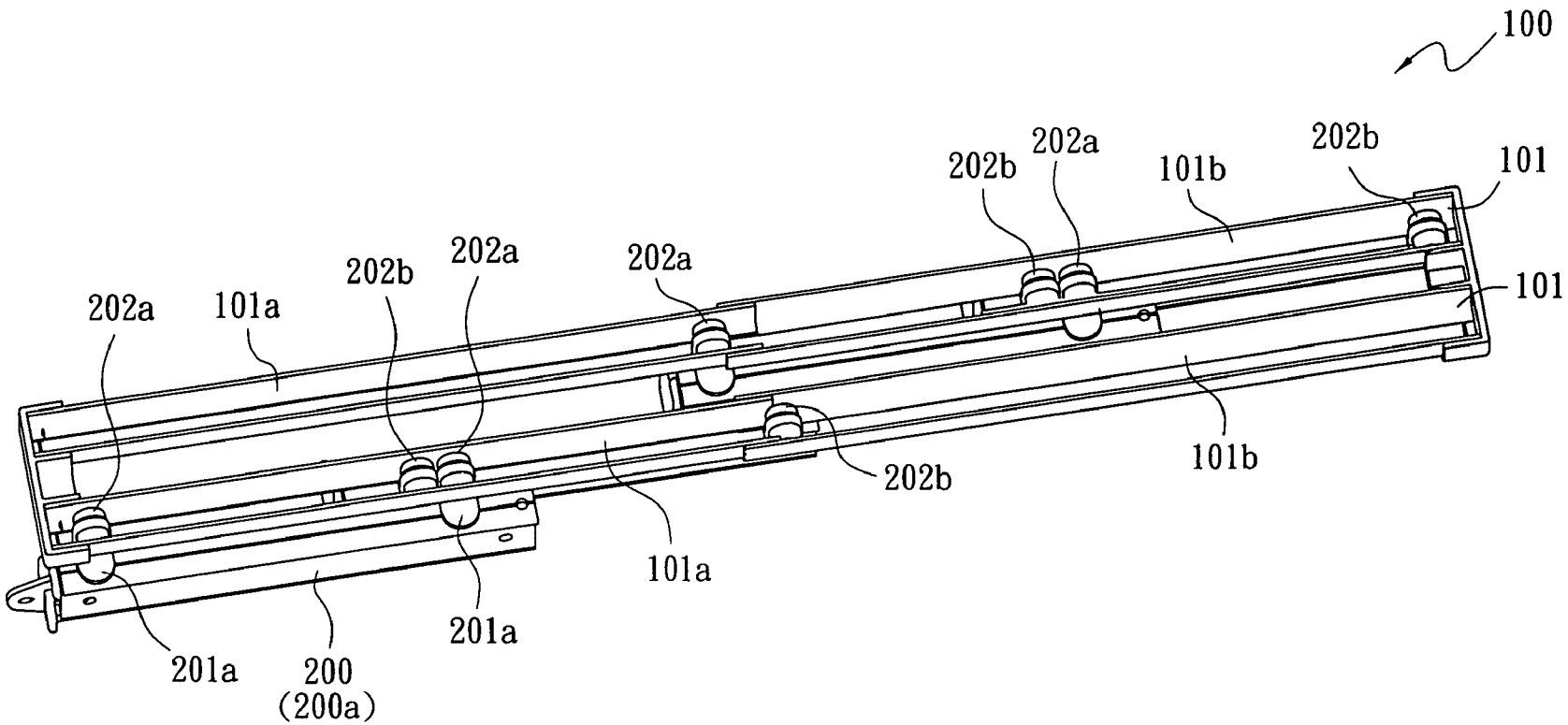
FIG. 6 is a perspective view of another embodiment having two rails and four carrier tracks in accordance with the present invention.

Referring to FIGS. 1-16, a sliding panel in accordance with the present invention consists of a rail set 100, a plurality of carrier tracks 200 and a plurality of panels 300. The rail set 100 includes at least one rail and preferably two or three rails 101 arranged in parallel while each of the panels 300 is attached to a respective one of the carrier tracks 200 by the top surface 301 thereof, as shown in FIG. 1 & FIG. 6. Each carrier track 200 and the panel 300 thereon slide under a channel 102 of the rail 101 for extending or retracting the sliding panel. Connectors 201 are disposed on top surface of each carrier track 200. Generally, one carrier track 200 is disposed with two connectors 201 and a runner 202 such as a caster or other part able to slide inside the channel 102 is connected on top of the connector 201. The connector 201 is inserted through a channel opening 103 on the bottom of the rail 101, so that the runner 202 slides inside the channel 102 of the rail 101 and further the carrier tracks 200 as well as the panel under the channel 102 are driven to move for extending or retracting.

The present invention is mainly characterized in that multiple (two, three or four) adjacent carrier tracks 200 are used and connectors 201 of each carrier track 200 are disposed in opposite directions and/or at intervals so that multiple carrier tracks 200 are able to slide parallel under the same channel 102. Moreover, the connectors 201 are arranged alternatingly on the top surface of each carrier track 200 so as to make the runners 202 of multiple adjacent carrier tracks 200 slide simultaneously inside the same channel 102. A plurality of carrier tracks 200 disposed under the same channel 102 slide in parallel for extending or retracting.

It is another feature of the present invention that only a single channel 102 is arranged on each of the rails 101. Then at least one or a plurality of rails 101 such as one, two or three are disposed in parallel to form a rail set 100 to achieve the requirements of simplified rail set formation, precision, and easy assembling.

It is a further feature of the present invention that the rail 101 consists of two-step type rails—an inner and an outer rail 101*a*, 101*b*. Thus the inner rail 101*a* can be pulled out from the outer rail 101*b* for extending the length of the rail. Therefore, the length of the rail 101 is adjustable. Moreover, the function that a channel 102 of a rail 101 holds a plurality of carrier tracks arranged in parallel is not influenced by such a design of the rail 101 composed of inner rail 101*a* and outer rail 101*b*.

As to the fact that multiple carrier tracks 200 and panels 300 slide in parallel under the channels 102 of the rails 101, basically it is necessary for them to be operated by other driving mechanism and positioning mechanism disposed over the sliding panels. Thus each of the carrier tracks 200 and the panels 300 slide transversely in sequence to be extended into an open or half-open pattern or slide in a reverse direction to be retracted into a stacked status. However, the driving mechanism and positioning mechanism could have various designs and are not features of the present invention and will not be described in detail.

Figure 7:
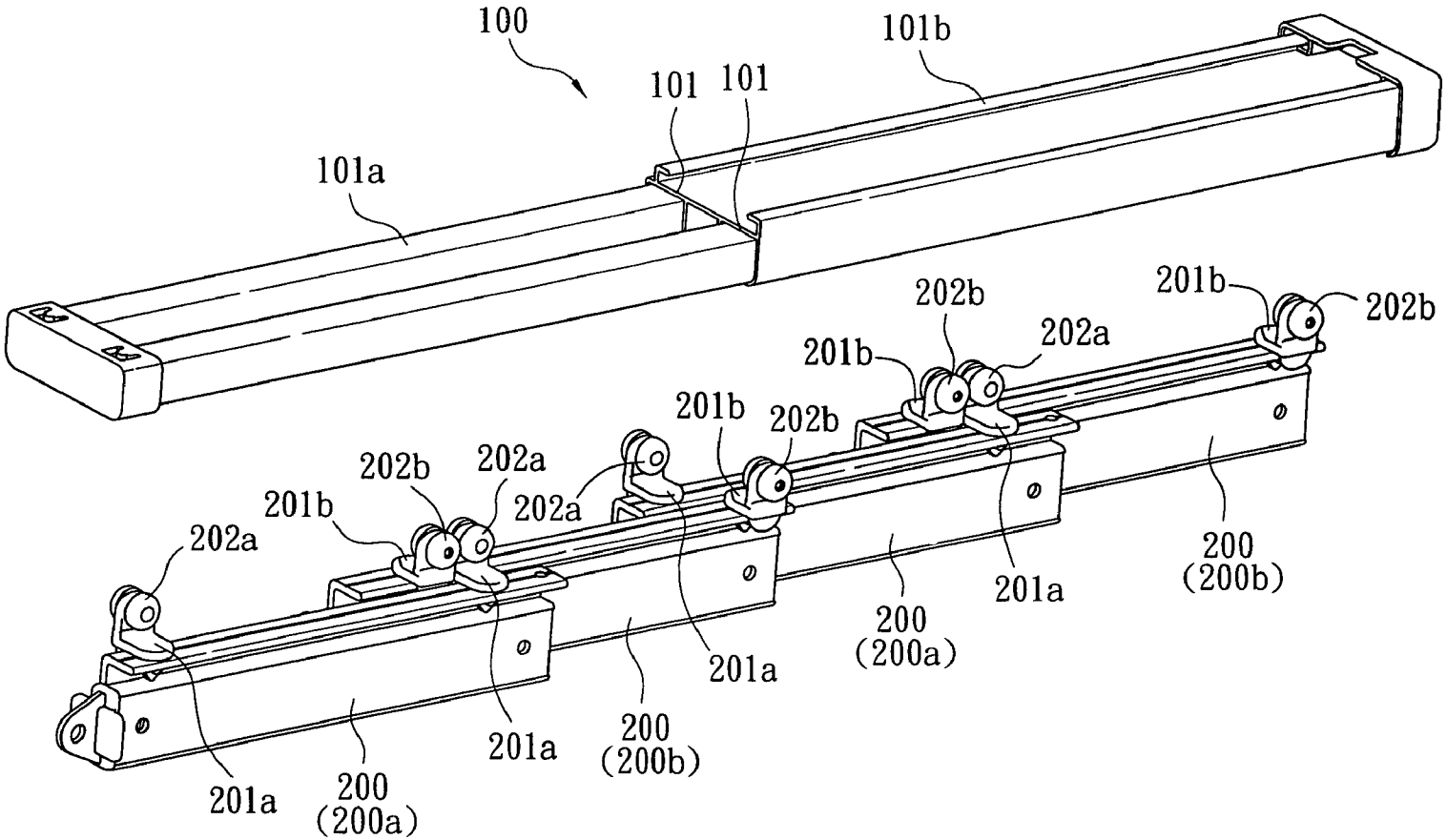
FIG. 7 is an explosive view of the embodiment in FIG. 6.
Figure 8:
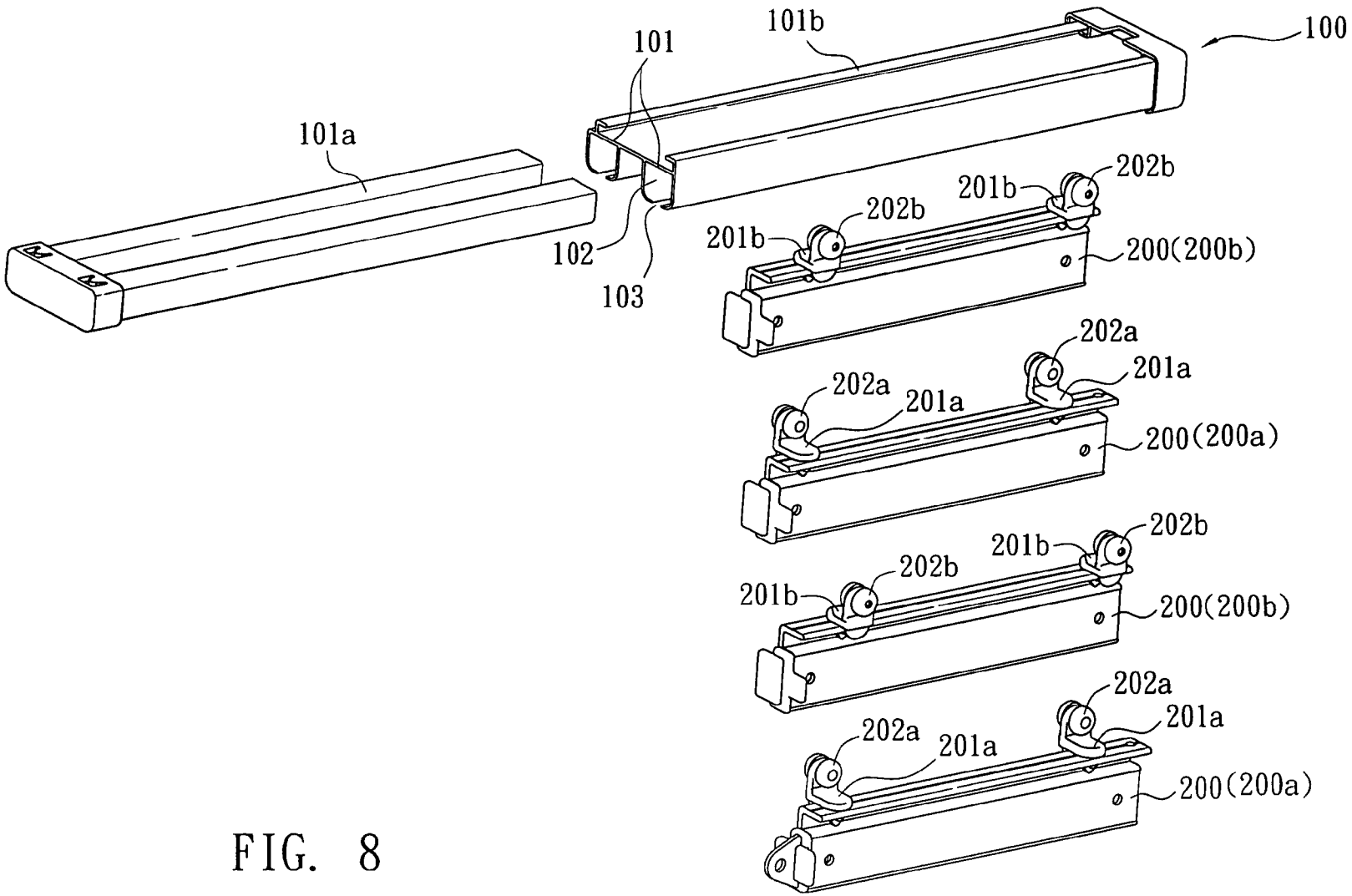
FIG. 8 is a perspective view showing separated carrier tracks of the embodiment in FIG. 7.
Figure 9:
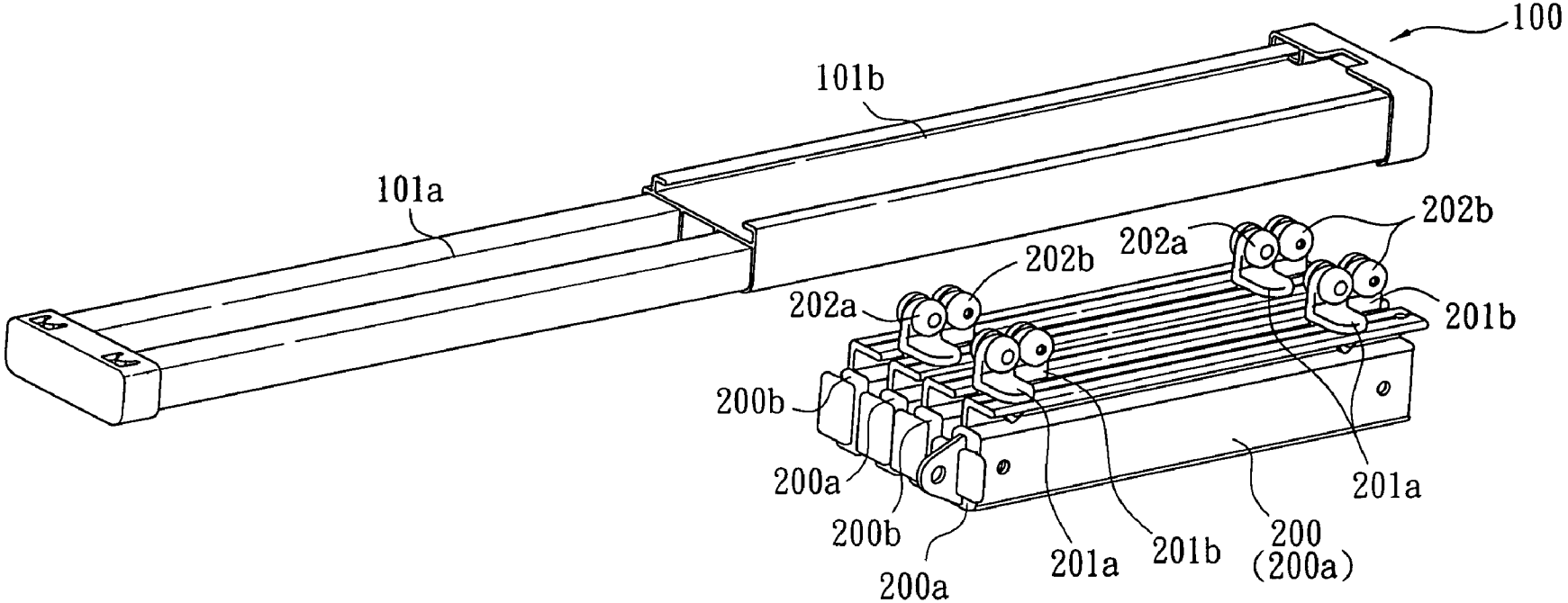
FIG. 9 is a perspective view showing the carrier tracks of the embodiment in FIG. 7 being arranged in parallel and overlapped with one another.
Figure 10B:
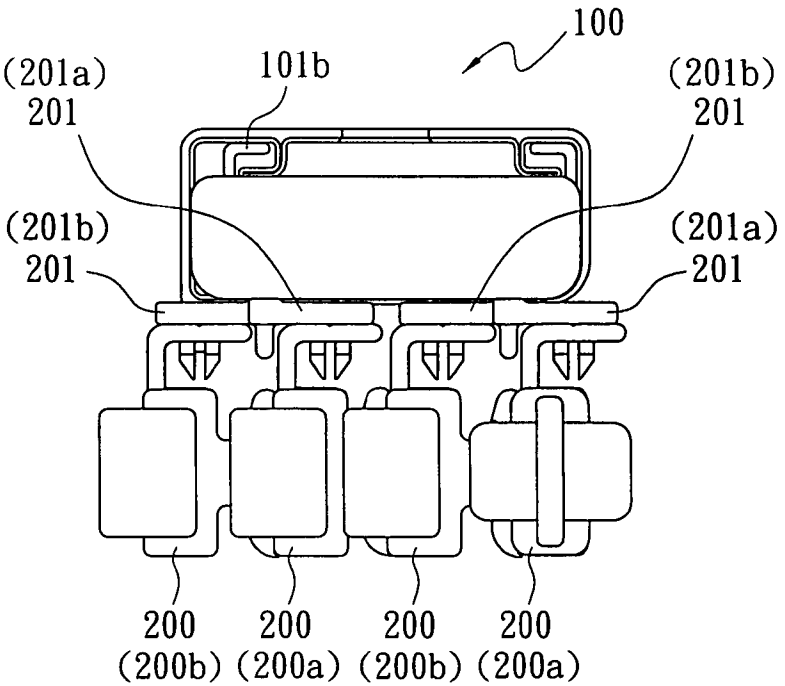
FIG. 10A, 10B are side views of the embodiment in FIG. 7.
Figure 10A:
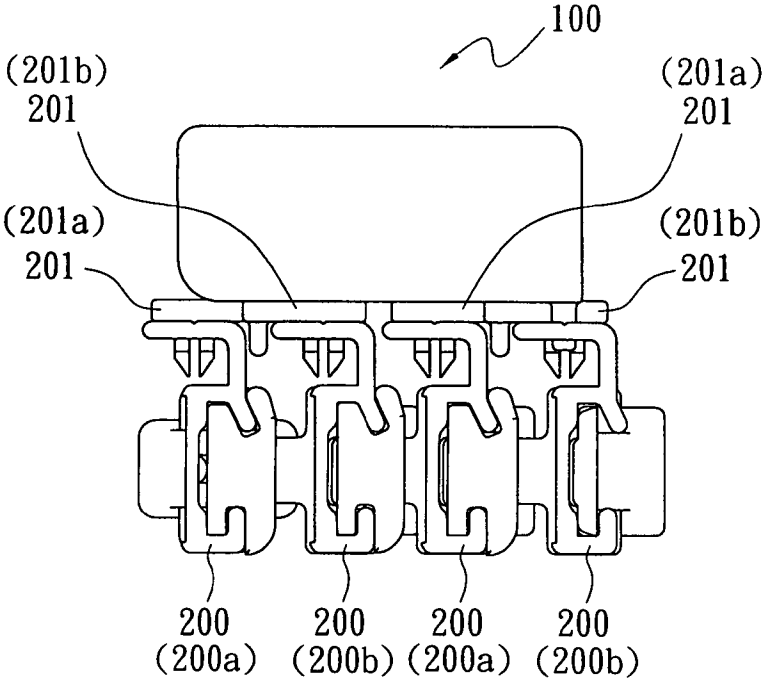
Figure 11A:
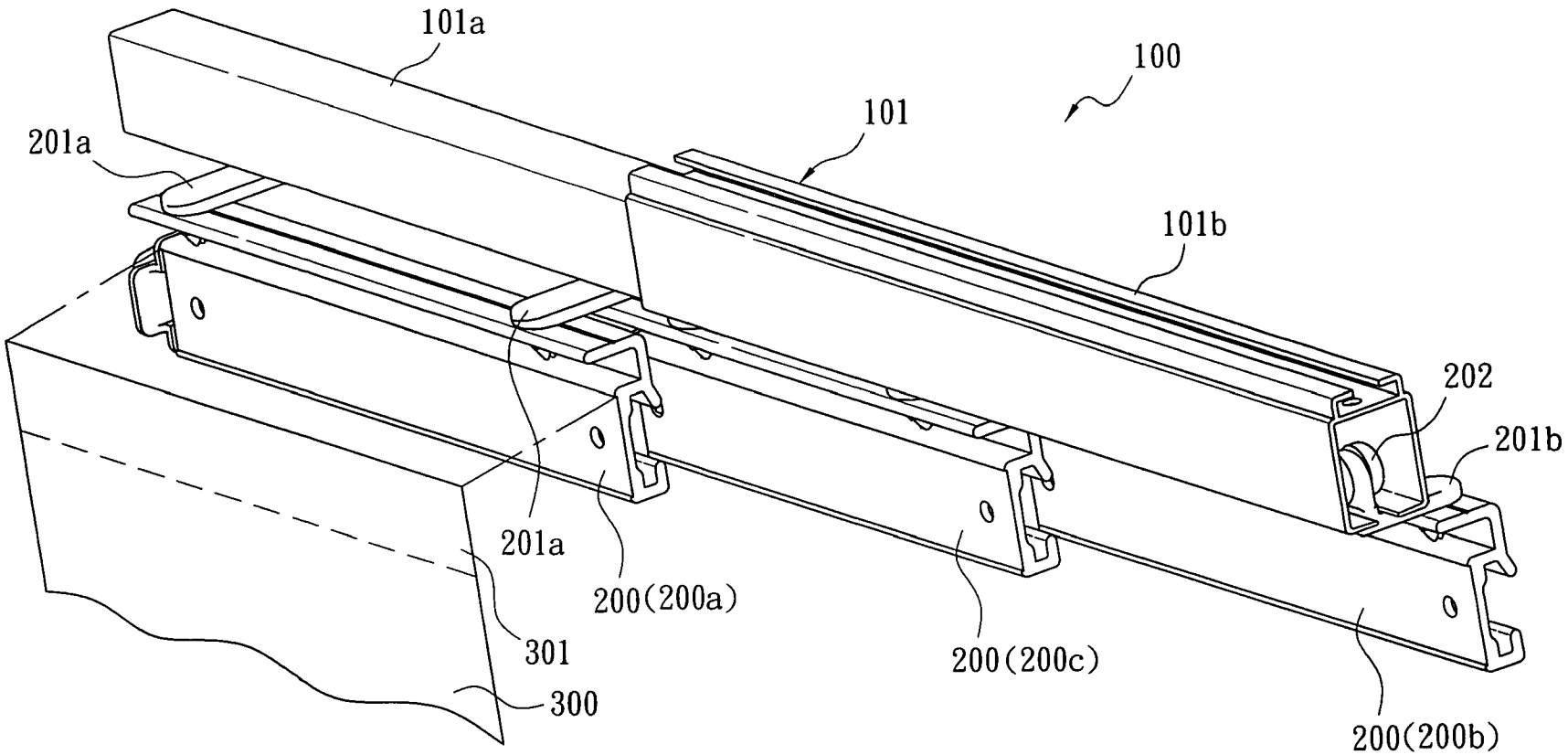
FIG. 11A, 11B are perspective views of another embodiment having one rail and three carrier tracks in accordance with the present invention.
Figure 11B:
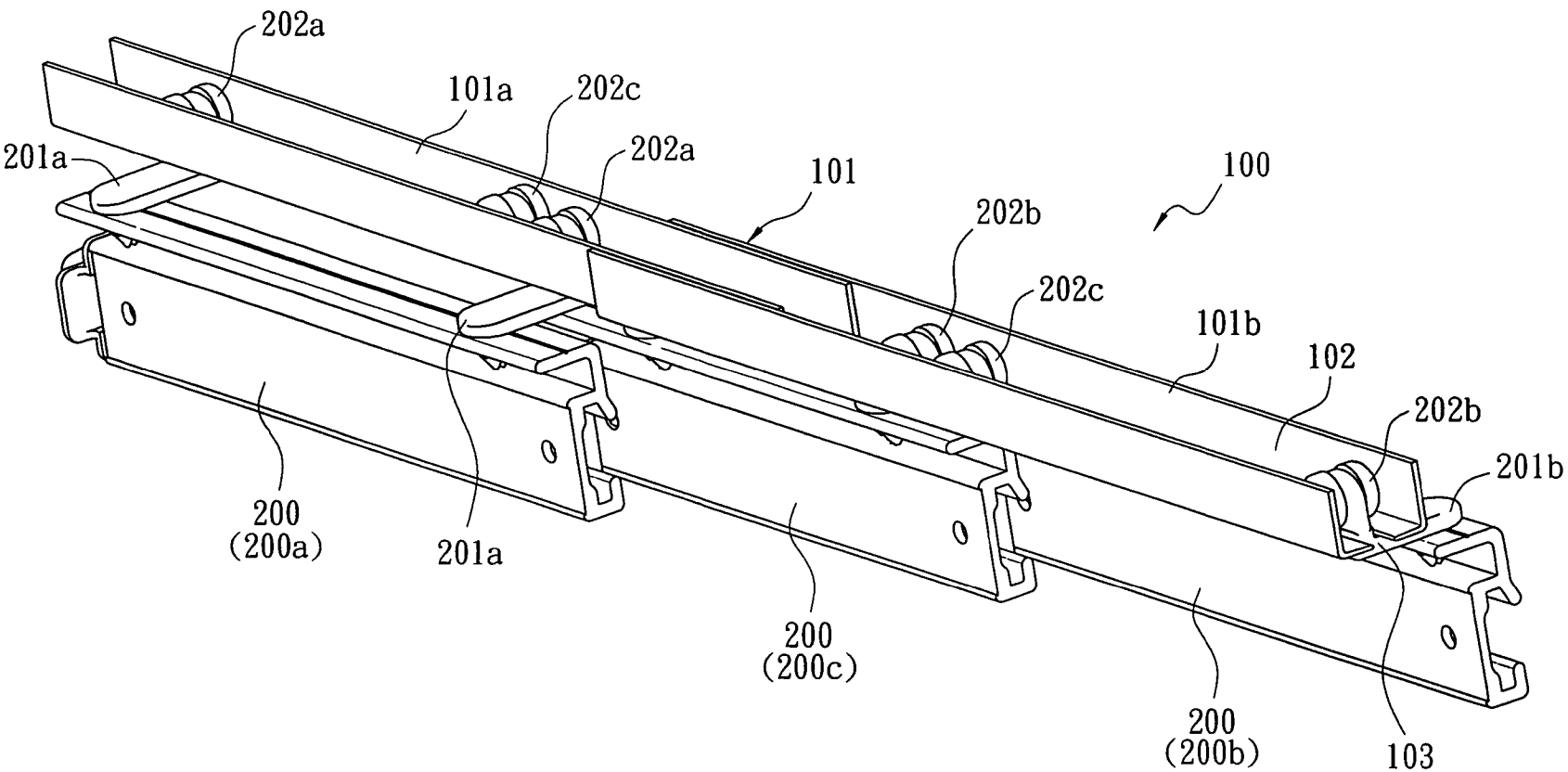
Figure 12:
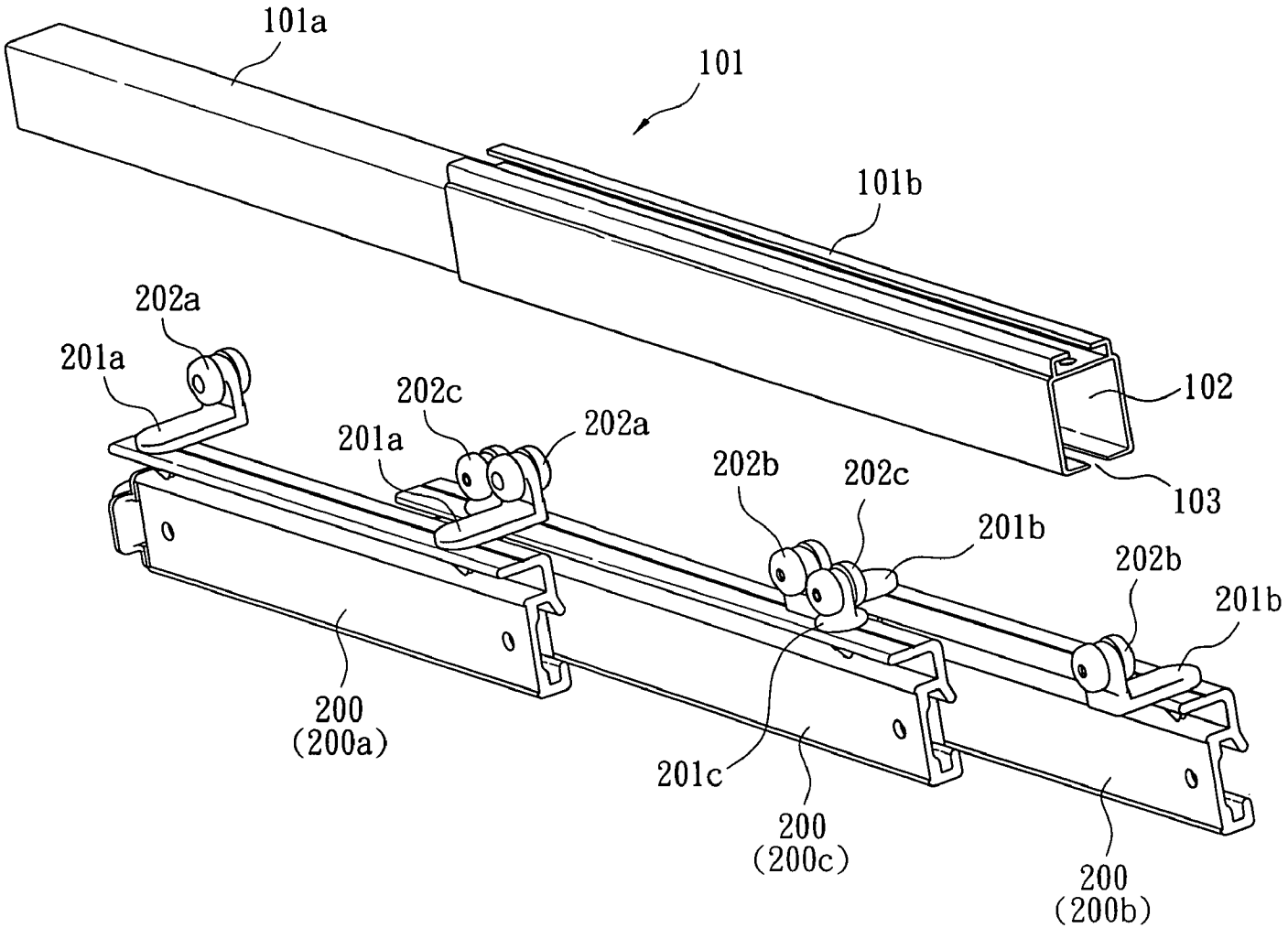
FIG. 12 is an explosive view of the embodiment in FIG. 11.
Figure 13:
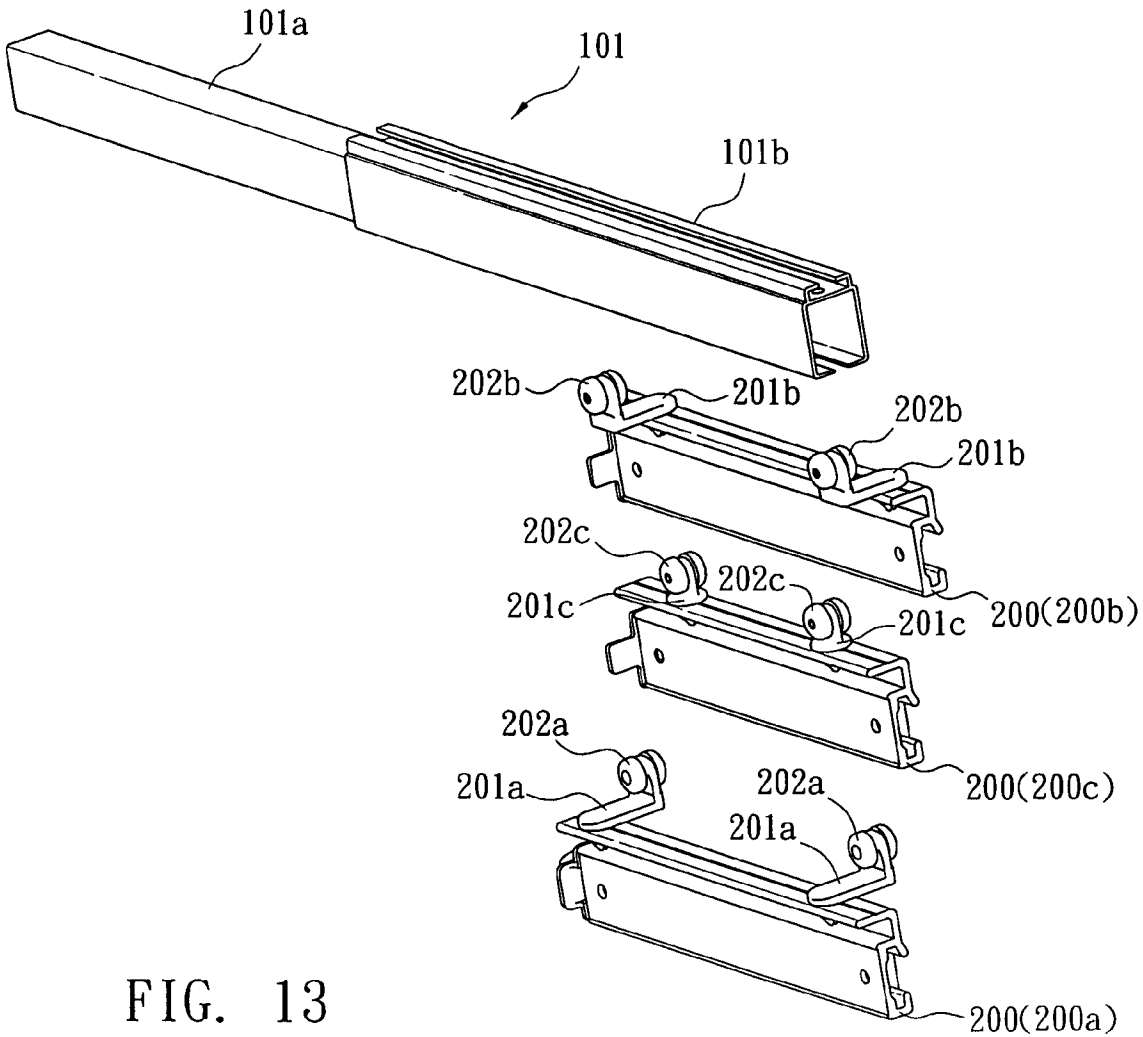
FIG. 13 is a perspective view of separated carrier tracks of the embodiment in FIG. 12.
Figure 15A:
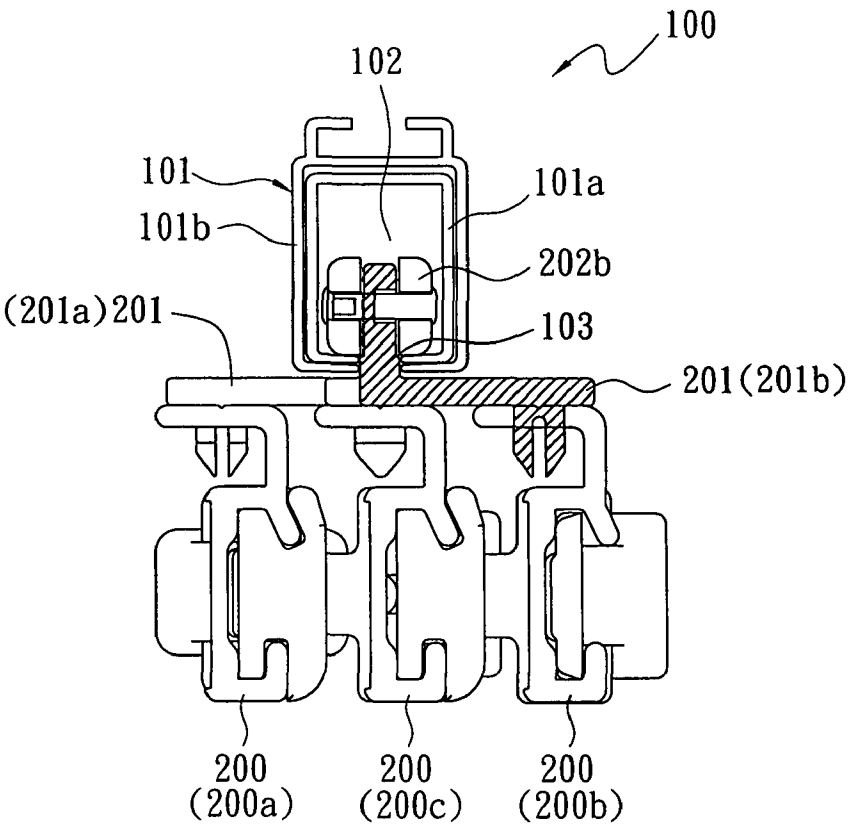
FIG. 15A, FIG. 15B, FIG. 15C are cross-sectional views of the three connectors of carrier tracks in accordance with the embodiment in FIG. 14.
Figure 14:
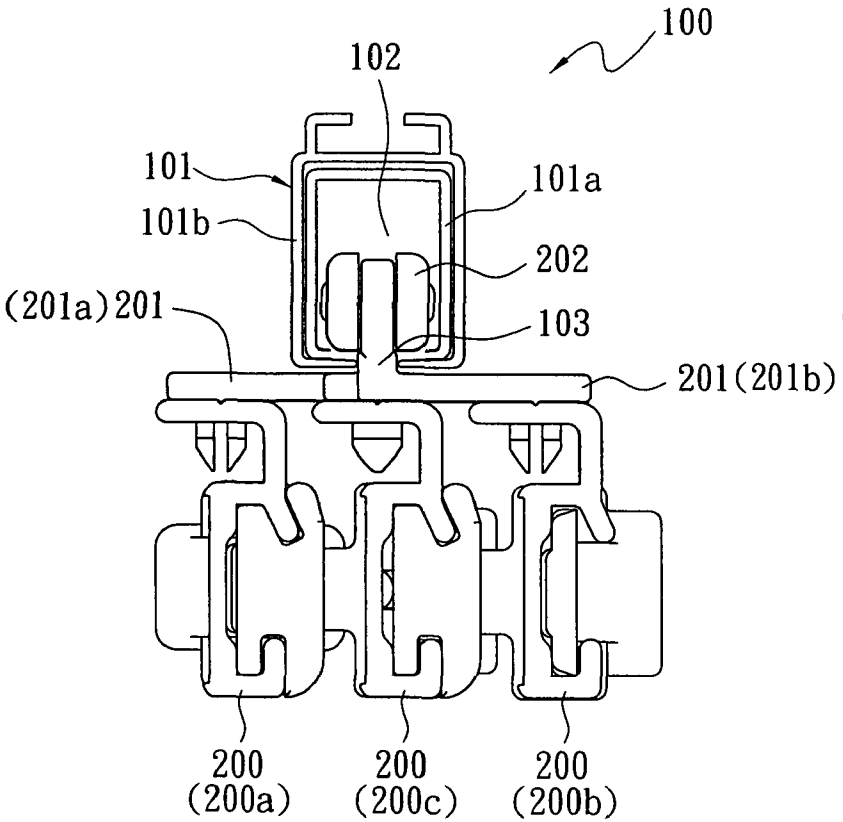
FIG. 14 is a side view of the embodiment in FIG. 11A.
Figure 16:
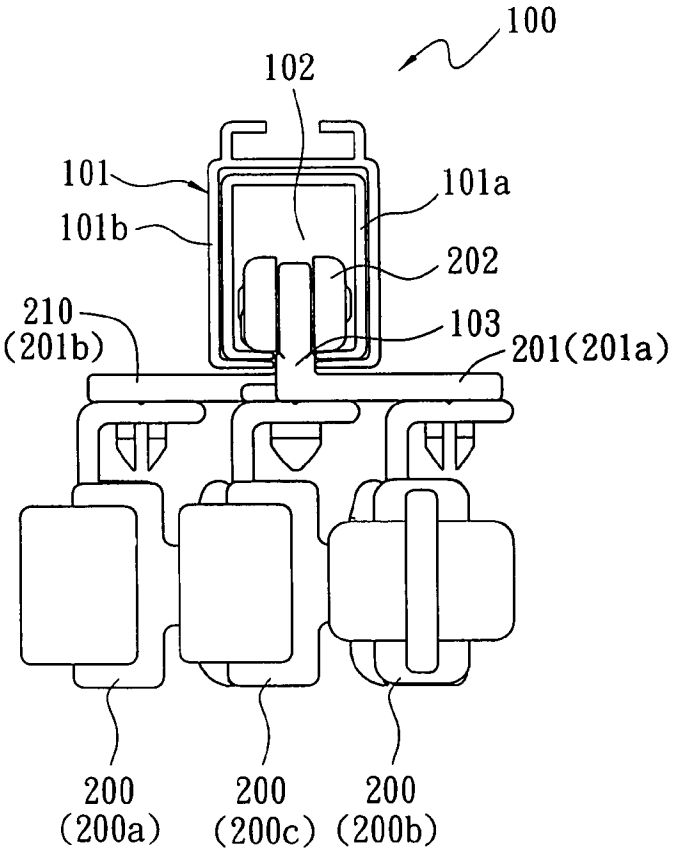
FIG. 16 is the other side view of the embodiment in FIG. 14.
Figure 15C:
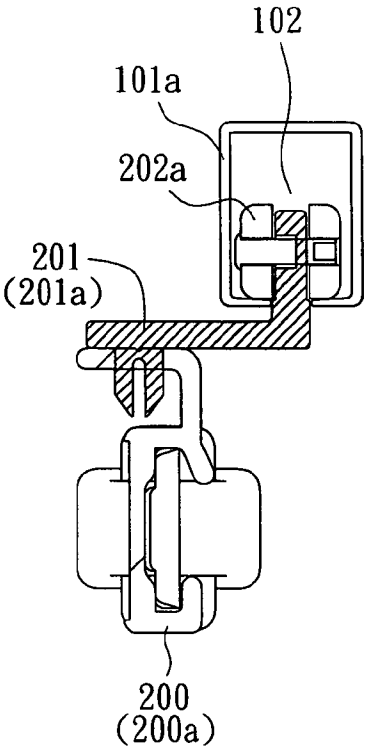
Figure 15B:
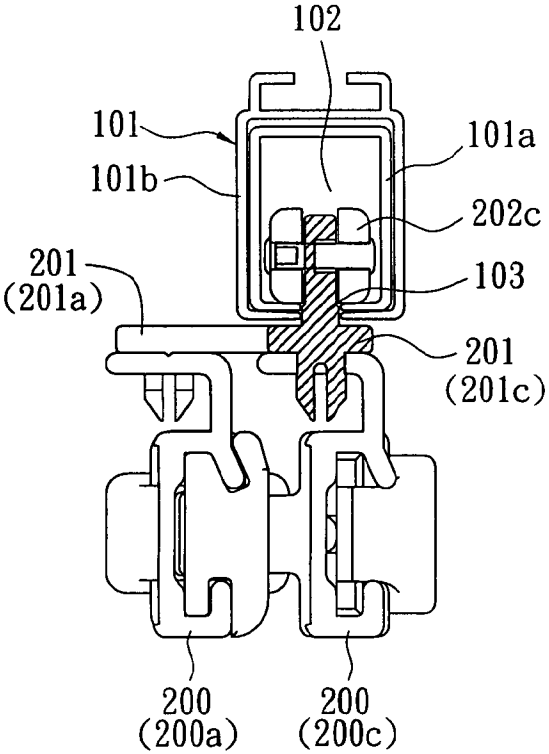

In addition, the rail set 100 is composed of at least one (1/2/3) rail 101. The outer rail 101*b* of each rail 101 is integrated, as shown in FIG. 7, FIG. 8 & FIG. 9, or secured by a fastening member so that several separated outer rails 101*b* are fastened into one body and a plurality of separated, parallel channels 102 is formed. Thus, a plurality of inner rails 101*a* is respectively mounted in each of the separated channels 102 which are pulled out to elongate the length of the rail 101.

Embodiment 1

Referring to FIG. 1 to FIG. 5, where only a single channel 102 is disposed on a rail 101 while two carrier tracks 200 are arranged in parallel under the single channel 102. The rail set 100 of this embodiment is composed of a rail 101.

The two connectors 201*a*, 201*b* are disposed in opposite directions on two carrier tracks 200*a*, 200*b* of the two adjacent panels 300. The right end of the connector 201*a* of the left carrier track 200*a* inserts through the channel opening 103 of the rail 101 and connects to one runner 202*a* while left end of the connector 201*b* of the right carrier track 200*b* inserts through the channel opening 103 of the rail 101 and connects to one runner 202*b*. Thus, the right connector 201*b* and left connector 201*a* are respectively located under left and right sides under the channel opening 103 of the channel 102. Furthermore, left and right carrier tracks 200*a*, 200*b* respectively connecting with the left and right connectors 201*a*, 201*b* are disposed in parallel on left and right sides under the channel opening 103 of the channel 102, and slide parallel to each other together with the two panels 300 they support.

Figure 2A:
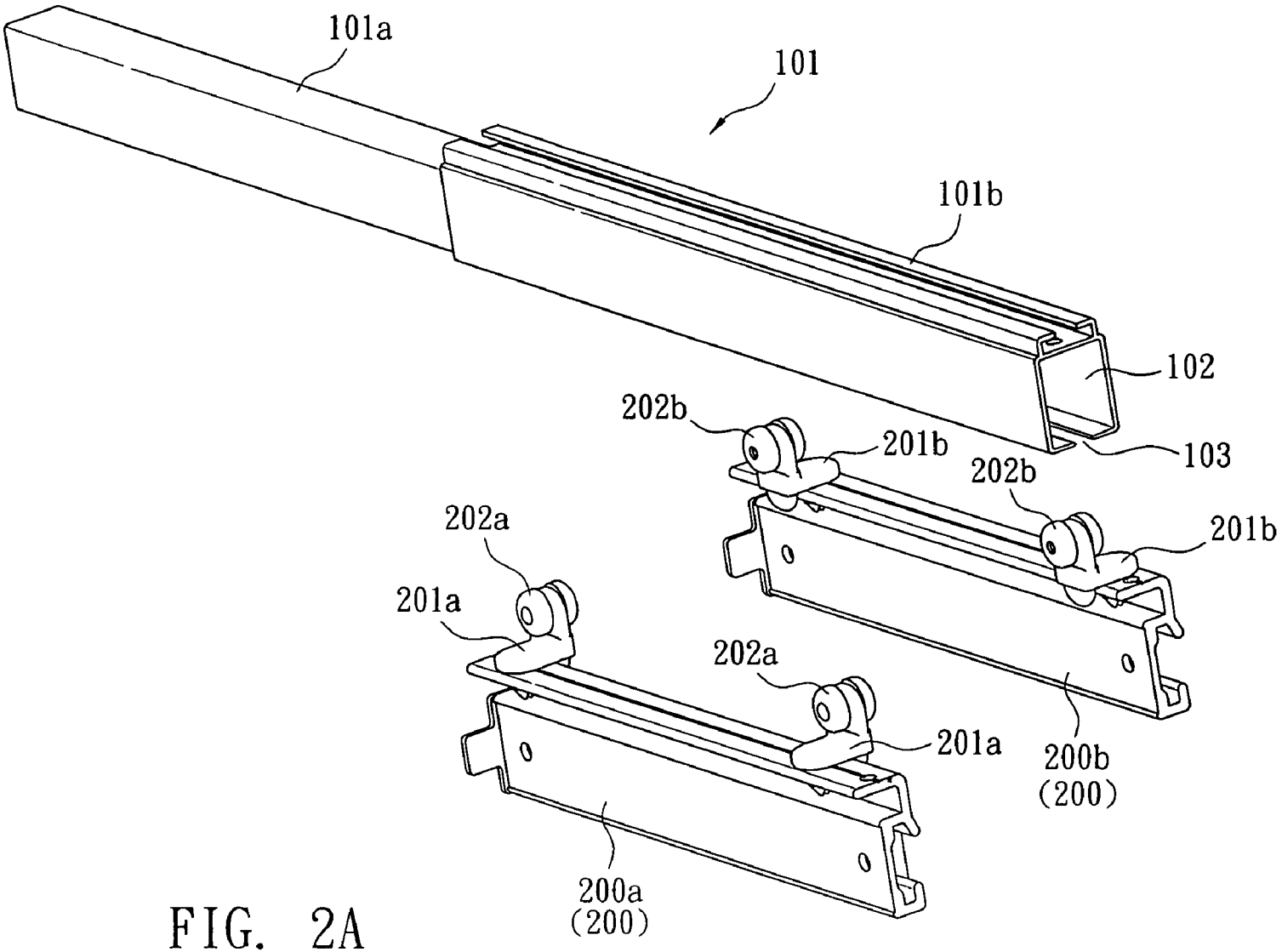
FIG. 2A is an explosive view of the embodiment in FIG. 1.
Figure 2B:
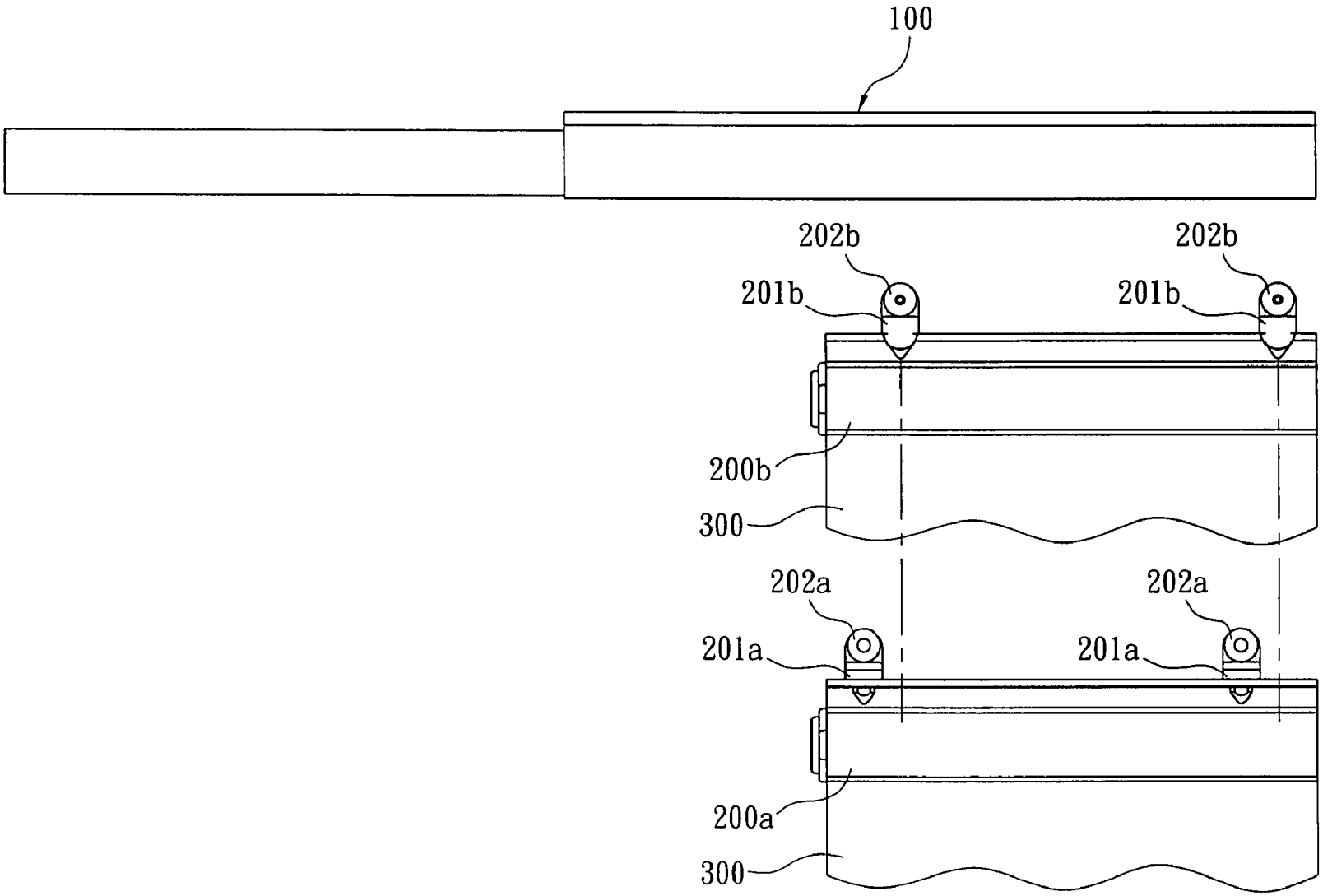
FIG. 2B is a schematic drawing showing the alternating arrangement of the connector's position on two adjacent carrier tracks in the same channel.
Figure 4A:
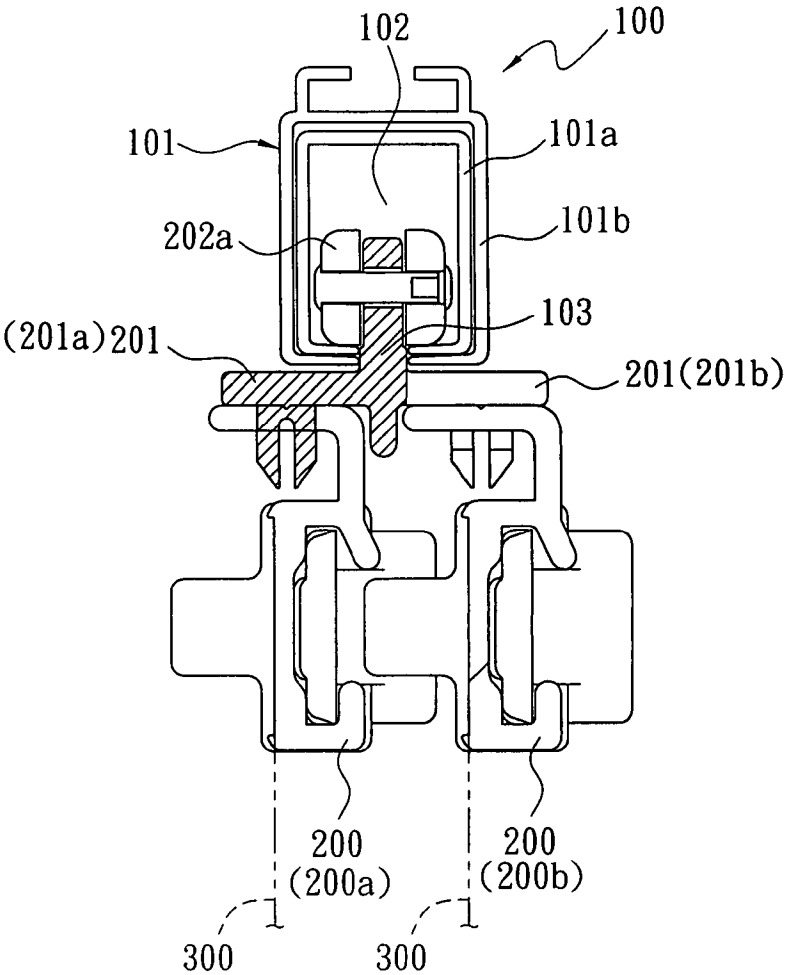
FIG. 4A, 4 B respectively are cross sectional views of connectors of the two carrier tracks in FIG. 3.
Figure 3:
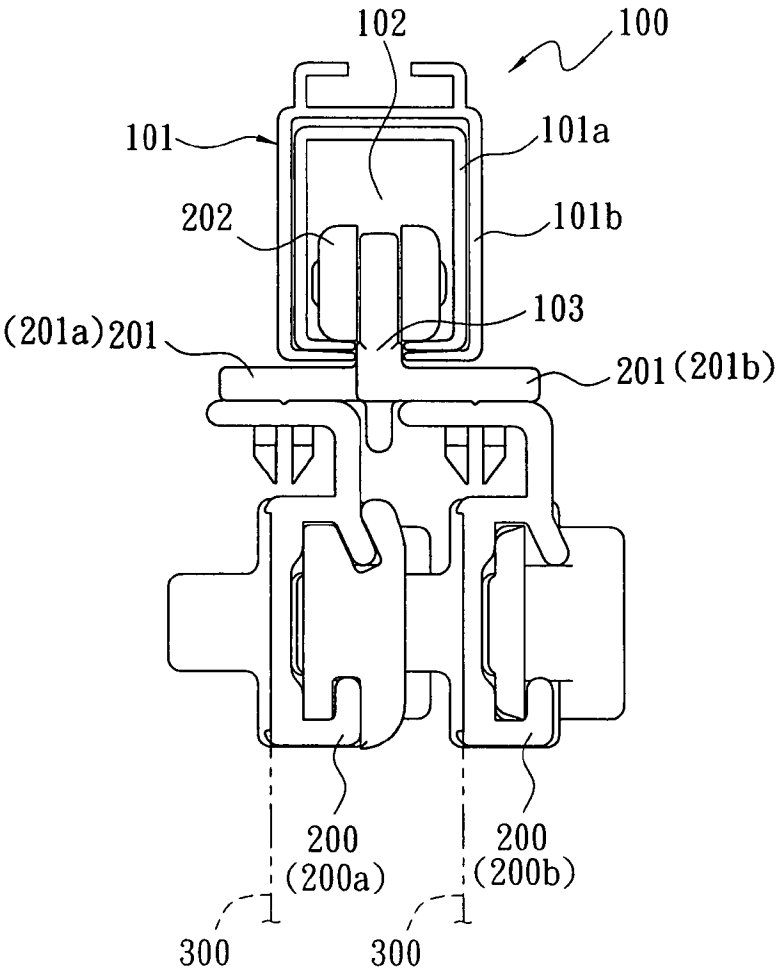
FIG. 3 is a side view of the embodiment in FIG. 1.
Figure 5:
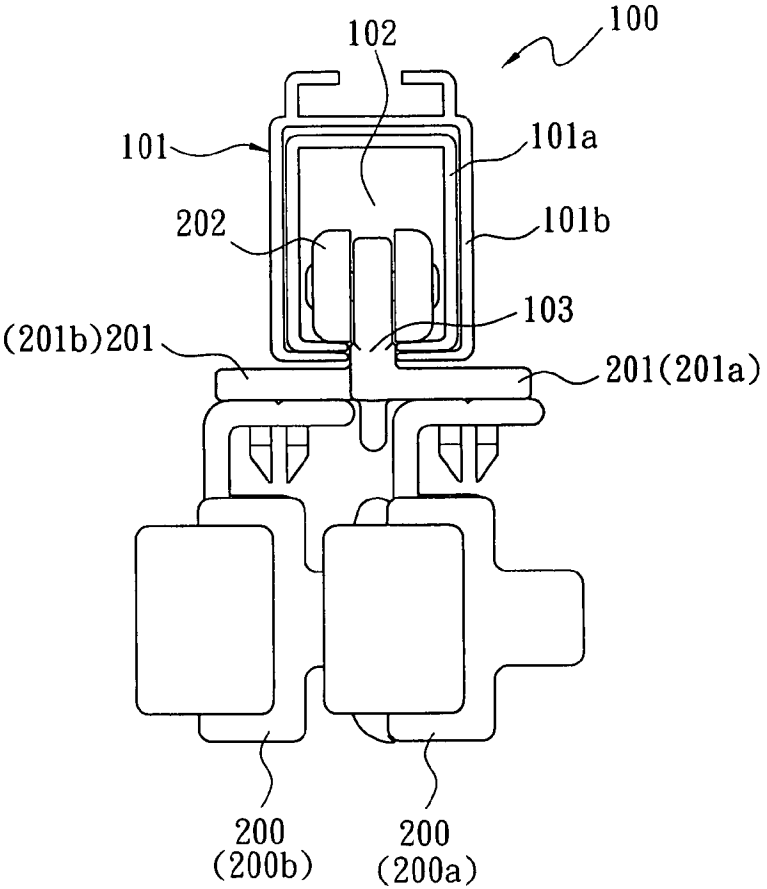
FIG. 5 is the other side view of the embodiment in FIG. 3.
Figure 4B:
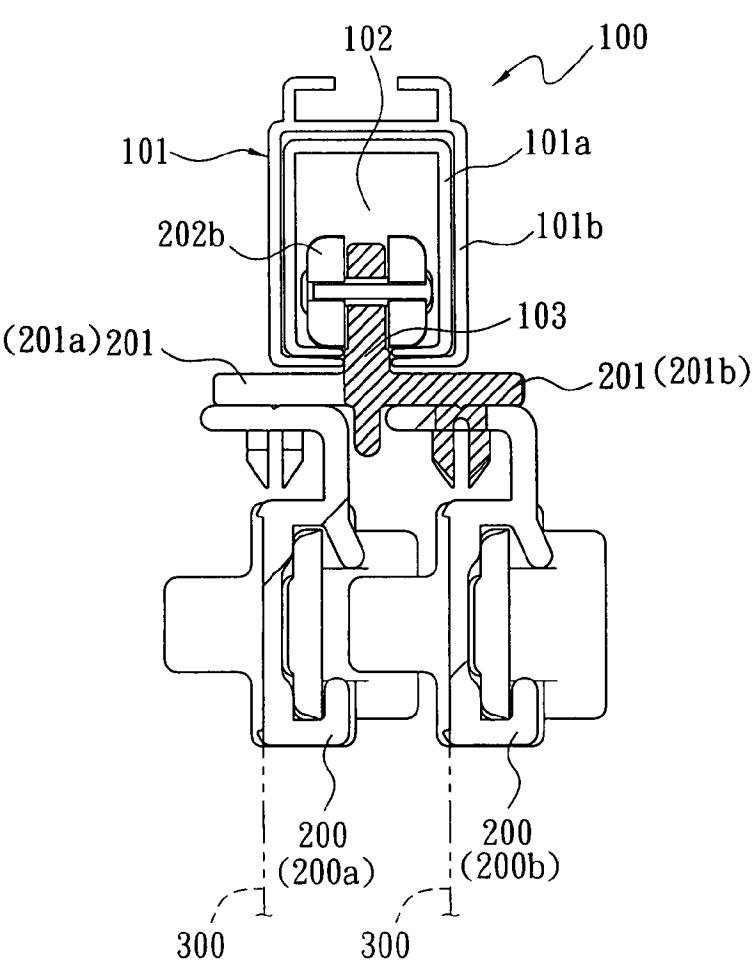

Moreover, the two connectors 201*a*, 201*b* as well as the runners 202*a*, 202*b* are disposed on the top surface of the left and right carrier tracks 200*a*, 200*b* in alternating positions. The alternating arrangement is that the two connectors 201*a*, 201*b* and the runners 202*a*, 202*b* follow in turns, succeeding each other, at certain intervals, as shown in FIG. 2A & FIG. 2B. The positions of the connectors 201*a*, 201*b* disposed on the two carrier tracks 200*a*, 200*b* are not symmetrical. When the connector 201*a* is disposed on a certain position of the carrier track 200*a*, the corresponding connector 201*b* is disposed on the adjacent carrier track 200*b*, away from the corresponding position of the connector 201*a*, as shown in FIG. 2A & FIG. 2B. Thus, the runners 202*a*, 202*b* slide simultaneously inside a single channel 102 of the rail 101. Therefore, the two adjacent carrier tracks 200*a*, 200*b* slide in parallel under the same channel 102 for extending or retracting the sliding panels.

Embodiment 2

Referring to FIG. 6 to FIG. 10A, 10B, where four carrier tracks 200 are disposed in parallel under two channels 102 of the two rails 101. The rail set 100 of this embodiment includes two rails 101. This embodiment is formed by two sets of the embodiment 1. The runners 202*a*, 202*b*, of the two carrier tracks 200*a*, 200*b* are simultaneously mounted and slide inside a channel 102 of each of the two rails 101. Thus the two adjacent carrier tracks 200*a*, 200*b* slide under each of the channels 102 in parallel.

Moreover, by the driving mechanism and the positioning mechanism disposed on the sliding panel, two sets of the two carrier tracks 200*a*, 200*b*, for a total of four carrier tracks—200*a*, 200*b*, 200*a*, 200*b* move in parallel under the rail set 100 composed of two rails 101 so as to be extended or retracted, overlapping with one another.

Embodiment 3

Referring to FIG. 11A to FIG. 16, where only one channel 102 is mounted on a rail 101 and there are three carrier tracks 200 arranged and sliding in parallel under the channel 102. The rail set 100 of this embodiment consists of one rail 101. The difference between this embodiment and the embodiment 1 is that a set of two adjacent carrier tracks 200*a*, 200*b* and the panels 300 thereof is replaced by a set of three adjacent carrier tracks 200*a*, 200*c*, 200*b* and the panels 300 thereof. The connectors 201*a*, 201*c*, 201*b* respectively disposed on the three carrier tracks 200*a*, 200*c*, 200*b* of the three adjacent panels 300 are arranged in opposite directions or at intervals. The distance between the left and right carrier tracks 200*a*, 200*b* is enlarged so as to add a middle carrier track 200*c* as well as a panel 300 therein. An alternating connector 201*c* is arranged between the two connectors 201*a*, 201*b* disposed in opposite directions. A middle part of the connector 201*c* of the middle carrier track 200*c* is inserted through the channel opening 103 of the rail 101 to connect with a runner 202*c*. Thus the left, middle and right connectors 201*a*, 201*c*, 201*b* are respectively located at the left, middle and right positions under the channel opening 103 of the channel 102 on the rail 101. Therefore, the left, middle and right carrier tracks 200*a*, 200*c*, 200*b* are arranged in parallel under the channel opening 103 and slide parallel to one another.

In addition, the three connectors 201*a*, 201*c*, 201*b* together with the runners 202*a*, 202*c*, 202*b* thereof are respectively arranged on top surfaces of the carrier tracks 200*a*, 200*c*, 200*b* in an alternating way, like the arrangement of embodiment 1 so as to make the runners 202*a*, 202*c*, 202*b* of the three adjacent carrier tracks 200*a*, 200*c*, 200*b* slide simultaneously inside the same channel 102. Thereby, the single channel 102 of the rail 101 allows the runners 202*a*, 202*c*, 202*b* of the three carrier tracks 200*a*, 200*c*, 200*b* to move at the same time therein so that the three carrier tracks 200*a*, 200*c*, 200*b* slide in parallel under the same channel 102 for extending or retracting the sliding panel.

Figure 17:
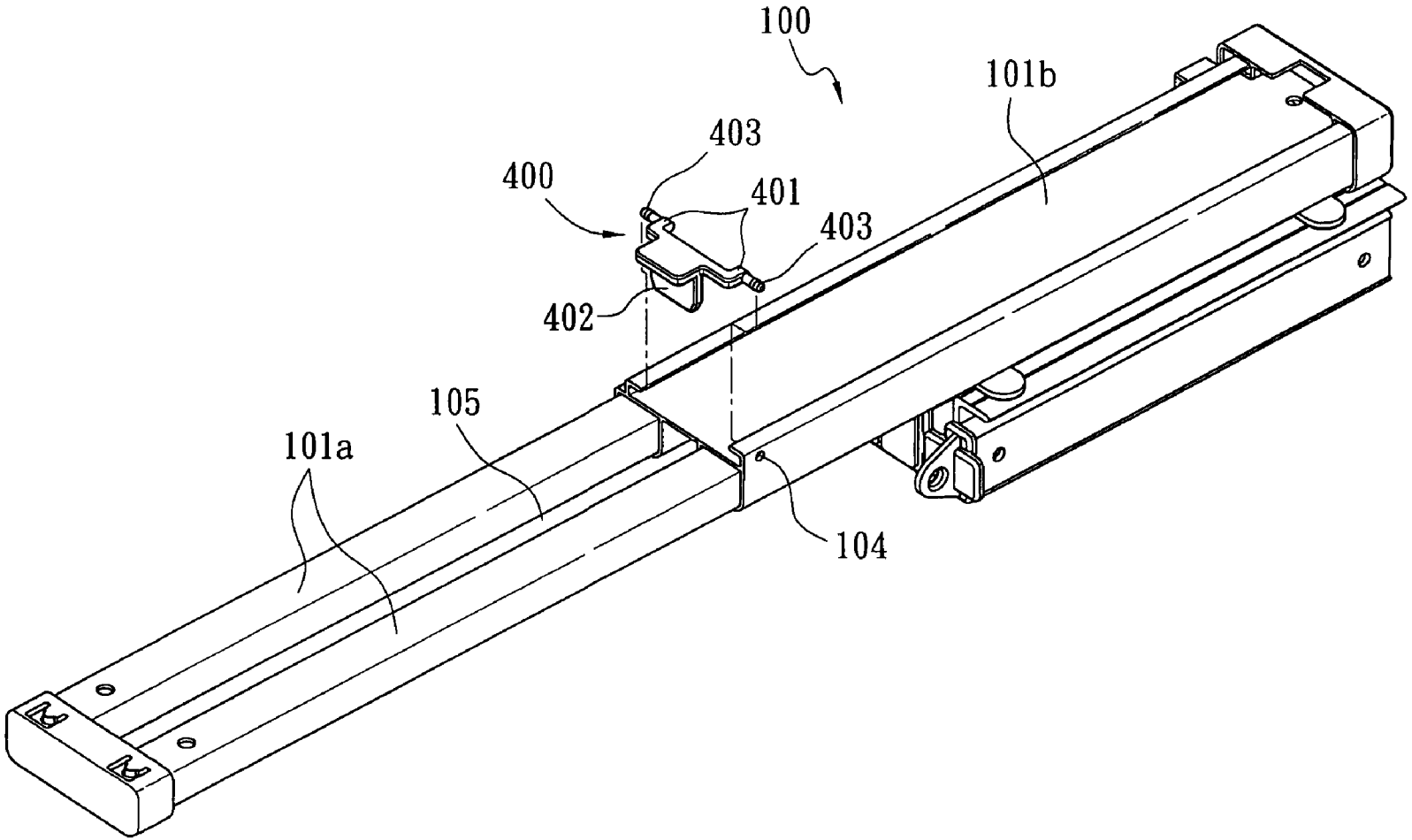
FIG. 17 is a perspective view showing a fixing clip disposed between an outer rail and two inner rails of the embodiment in FIG. 7.
Figure 17A:
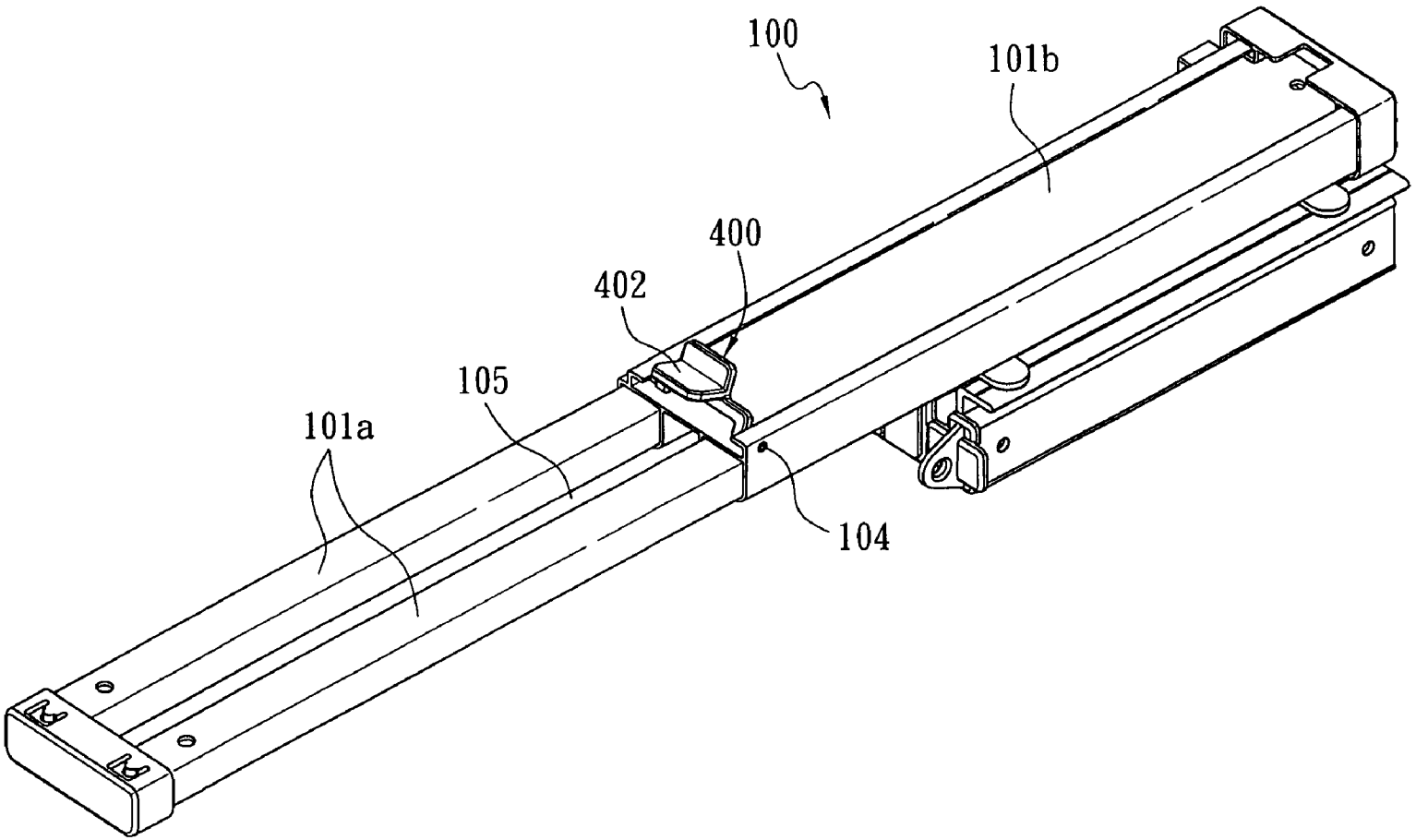
FIG. 17A is an assembling view of the embodiment in FIG. 17.
Figure 17B:
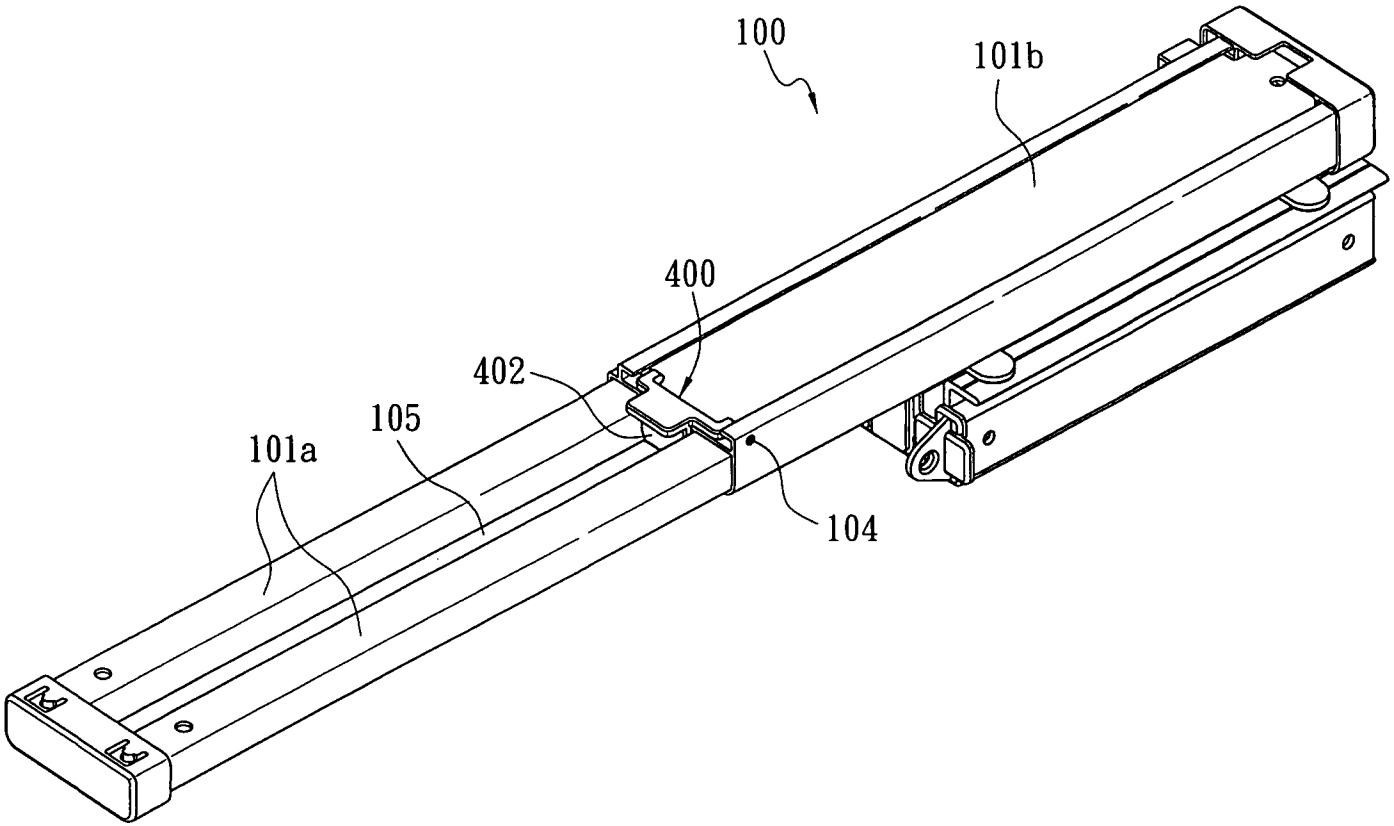
FIG. 17B is a perspective view showing the embodiment in FIG. 17 being used (after being fixed)
Figure 18:
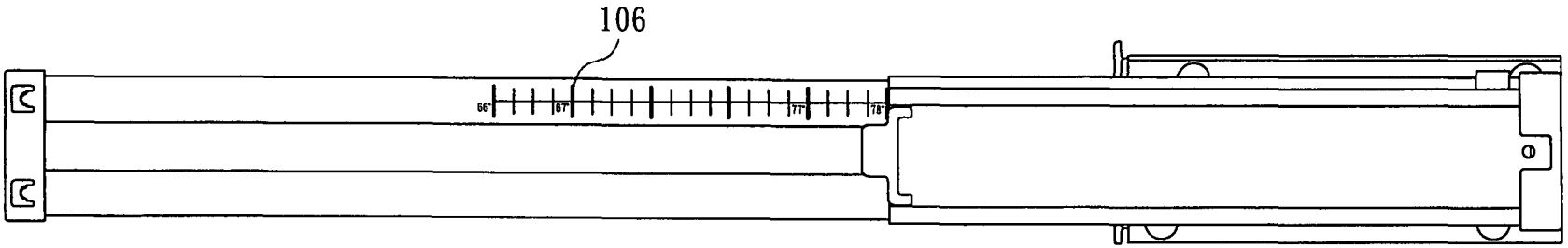
FIG. 18 is a top view showing a measuring tape disposed on an inner rail of the rail set of the embodiment in FIG. 7.

Referring to FIG. 3, FIG. 4A, FIG. 4B, FIG. 14 and FIG. 15A to FIG. 15C, where the rail 101 consists of an inner rail 101*a* and an outer rail 101*b*. When the inner rail 101*a* is pulled out from the outer rail 101*b* for extending the length of the rail, there is a height difference between the inner rail 101*a* and the outer rail 101*b* where the height difference is equal to the thickness of the inner rail 101*a*. The distance between the bottom of the runner 202 and each of the connectors 201 that inserts through the channel opening 103 on bottom of the rail 101 is no less than the total thickness of the inner and the outer rails 101*a*, 101*b* so that the connector 201 will not be locked or stopped while passing through the overlapping area of the inner rail 101*a* and the outer rail 101*b*. Moreover, the runner 202 is preferable a caster so that when the runner 202 slides forwards and backwards inside the channel 102 of the rail, it can move smoothly through the height difference between the inner rail 101*a* and the outer rail 101*b*. Referring to FIG. 17 to FIG. 17B, where a fixing clip 400 is disposed between the outer rail 101*b* and the inner rail 101*a*. The fixing clip 400 having two symmetrical arms 401 and a stopping block 402 is made from plastic injection molding. A projecting rod 403 is disposed on a rear end of each of the arms 401. The two symmetrical projecting rods 403 are inserted into two symmetrical holes 104 on a top surface of the outer rail 101*b* by the elasticity of the two arms 401 so that the fixing clip 400 is fixed on the outer rail 101*b* and is pivotable. Referring to FIG. 17A, when the two inner rails 101*a* are pulled out of the outer rail 101*b* to the required length synchronously, users can rotate the fixing clip 400 to make the stopping block 402 insert into a gap 105 between the two inner rails 101*a*, as shown in FIG. 17B. Thus, both the outer rail 101*b* and the two inner rails 101*a* are fixed. The fixed rail length is convenient for subsequently assembling the rail set 100. Moreover, referring to FIG. 18, a measuring tape 106 is disposed on the top surface of the inner rail 101*a* for the convenience of users to adjust the length of the rails.

In summary, the present invention has a rail 101 and a channel 102 disposed with a plurality of carrier tracks 200. Once a rail set 100 of the present invention consists of two rails 101 arranged in parallel, it allows the disposition of four or six panels 300 thereof. If the rail set 100 includes three rails 101 arranged in parallel, it allows disposition of six or nine panels 300 thereof. Thus the number of the rails 101 being used by the present invention is only a half or one third of the number of the panels 300. Or in the similar way, the ratio can be one fourth (a channel 102 disposed with four carrier tracks 200). Moreover, the length of the rail is adjustable. Compared with conventional structures that have a rail with certain length, having multiple channels while each channel is only disposed with one carrier track, the present invention has better application.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A sliding panel comprising:

a rail set having at least one C-shaped rail extending in a longitudinal direction, at least one C-shaped rail channel opening on a bottom thereof, the channel opening extending in a horizontal direction;

a first carrier track and a second carrier track mounted under the rail, each carrier track having a panel attached thereto and the first and second carrier tracks being side by side under the channel opening of the at least one rail and being slidable parallel to one another;

at least one pair of connectors, each connector having an L-shape with first and second portions, one connector of the pair being on a top surface of the first carrier track while another of the connectors of the pair being on a top surface of the second carrier track, each of the first portions of the pair of connectors extending toward the at least one rail while the second portions of the pair of connectors extend away from one another, the first portion of the pair of connectors being inserted through the channel opening of the rail and each of the connectors of the pair of connectors being attached to a pair of runners inside the channel, a center of each runner of one pair of runners being a same distance from the channel opening and being in a same horizontal plane, the runners with the connectors being simultaneously movable along the at least one rail such that the first and second carrier tracks slide in parallel under the channel for extending or retracting the panels, when retracted, the panels are at one end of the at least one rail and lengths of the panels in the longitudinal direction of the at least one rail are completely overlapping, each of the connectors of the pair of connectors being offset relative to one another in the longitudinal direction of the rail when the panels are retracted and overlapping.

2. The sliding panel as claimed in claim 1, wherein the connectors are one-piece connectors.

3. The sliding panel as claimed in claim 1, wherein each of the connectors of the pair of connectors are always offset relative to one another in the longitudinal direction of the rail.

4. The sliding panel as claimed in claim 1, wherein the runners of a pair of runners rest on portions of the at least one rail on both opposite sides of the channel opening.

5. The sliding panel as claimed in claim 1, wherein the at least one rail set comprises an inner rail and an outer rail so that the inner rail and the outer rail can be telescoped for increasing/decreasing the length of the rail.

6. The sliding panel as claimed in claim 5, wherein the at least one rail set comprises a plurality of rails arranged in parallel.

7. The sliding panel as claimed in claim 1, wherein the at least one rail set comprises a plurality of rails arranged in parallel, one rail being an outer rail and one rail being an inner rail.

8. The sliding panel as claimed in claim 7, wherein a pivotable fixing clip is disposed between the outer rail and the inner rail; the fixing clip having two symmetrical arms and a stopping block, with a projecting rod disposed on a rear end of each of the symmetrical arms so as to allow the insertion of the two projecting rods into two symmetrical holes on a side surface of the outer rail; when the inner rail is pulled out of the outer rail to a required length, the fixing clip is rotated so as to insert the stopping block into a gap between the two adjacent inner rails to fix the relative position between the outer rail and the inner rail.

9. The sliding panel as claimed in claim 1, wherein a measuring tape is disposed on a top surface of one of the at least one rail of the rail set.

* * * * *